US006018933A

United States Patent [19]

Gallagher

[11] Patent Number: 6,018,933

[45] Date of Patent: Feb. 1, 2000

[54] PRE-BAGGING METHOD AND APPARATUS

[75] Inventor: Denis Gallagher, Naperville, Ill.

[73] Assignee: McNeil-PPC, Inc., Skillman, N.J.

[21] Appl. No.: 09/247,765

[22] Filed: Feb. 9, 1999

[51] Int. Cl.[7] ..... B65B 63/02

[52] U.S. Cl. ..... 53/438; 53/448; 53/529; 53/542

[58] Field of Search ..... 53/258, 436, 438, 53/439, 448, 523, 529, 530, 526, 542, 543

[56] References Cited

U.S. PATENT DOCUMENTS

| | | | |
|---|---|---|---|
| 2,969,629 | 1/1961 | Blais | 53/529 |
| 3,608,269 | 9/1971 | Gore | 53/529 X |
| 4,062,169 | 12/1977 | Lister et al. | 53/439 |
| 4,141,193 | 2/1979 | Joa | 53/529 |
| 4,241,562 | 12/1980 | Meyer | 53/529 X |
| 4,250,688 | 2/1981 | Lingenfelder | 53/529 X |
| 4,492,070 | 1/1985 | Morse et al. | 53/529 X |
| 4,577,453 | 3/1986 | Hofeler | 53/529 X |
| 4,679,379 | 7/1987 | Cassoli | 53/438 |
| 4,875,328 | 10/1989 | Meyer | 53/529 |
| 5,127,209 | 7/1992 | Hunter | 53/529 X |
| 5,473,869 | 12/1995 | Chikatani | 53/529 X |
| 5,564,261 | 10/1996 | Kiner | 53/529 X |

*Primary Examiner*—Daniel B. Moon

[57] ABSTRACT

A method and apparatus for compressing a row of vertically arranged, wrapped disposable articles, by pushing on three sides of a six-sided row of the articles, while confining the other 3 sides of the row with a confining surface. One of those confining surfaces, a gate, is movable into and out of its confining position, and prevents blow-out of the middle portion of the row that otherwise occurs in the absence of the gate.

9 Claims, 5 Drawing Sheets

PRE-BAGGING METHOD AND APPARATUS

FIELD OF THE INVENTION

The invention relates to a pre-bagging compression apparatus and method, more specifically, one that compresses at least one generally horizontal row of vertically disposed articles, without forcing out of the row, the middle portion thereof.

BACKGROUND OF THE INVENTION

It is known to compress a row or rows of articles prior to pushing the row into a bagger, so that the maximum number of articles can be placed into a bag of fixed dimensions. Particularly, this is important in those instances in which the articles are wrapped and compressible, such as is the case with disposable feminine hygiene articles. However, the conventional prebagger compression unit for doing this provides compression on only 5 of the six sides of the row or rows of articles, because the non-contacted sixth side is the direction that the compressed row is then pushed to enter it into the bagger. This occasionally creates a blow-out problem during compression—some of the articles in the row having non-contact on the sixth side are squeezed out of the row, and the row collapses or is jammed with non-aligned articles. Particularly this is a problem as the row is made longer and longer for larger sized packaging, or when there is a double row, one in front that is fully contacted, and one in back that is not contacted on the sixth side.

Hence, prior to this invention there has been a need for a prebagging compression apparatus and method that avoid the blow-out problems noted above.

SUMMARY OF THE INVENTION

I have designed apparatus and a method that solve the aforesaid problems.

More specifically, in accord with one aspect of the invention there is provided a method of preventing blowout of a row of generally flat wrapped disposable feminine hygiene articles, when compressing prior to bagging, said articles each comprising two major opposing surfaces, two opposing side surfaces, and two end surfaces; the method comprising the steps of:

a) placing a plurality of such articles on a platform in a generally horizontal row of a predetermined height so that each article is vertically disposed on said platform with at least one major surface in approximate contact with a major surface of an adjacent article and an end surface resting on said platform;

b) moving said at least one row into a pre-bagging apparatus comprising a floor, a ceiling spaced from the floor a generally fixed distance approximately equal to said height, movable side walls capable of pressing against opposite ends of said row of articles, and a movable blocking gate projecting above the height of said floor, said moving step continuing until a first side edge of each article in said row is abutted against and in contact with said blocking gate; and c) while moving said movable side walls together to push against said opposite row ends, pushing uniformly against said row along the other side edge of said articles opposite to said first side edge, thereby compressing said row into a minimized volume suitable for bagging, without blow-out of articles from said row.

In accord with another aspect of the invention, there is provided a pre-bagging compression apparatus for compressing a row of flat wrapped articles each having a predetermined height and comprising two major opposing surfaces, two opposing side surfaces, and two end surfaces, the apparatus comprising:

a floor, a ceiling spaced from the floor a generally fixed distance approximately equal to said height of said articles, movable side walls capable of pressing against opposite ends of said row of articles, and a movable blocking gate projecting above the height of said floor, and means for raising and lowering said gate relative to said floor.

In accord with yet another aspect of the invention, there is provided a pre-bagging compression apparatus for compressing a row of flat wrapped articles each having a predetermined height and comprising two major opposing surfaces, two opposing side surfaces, and two end surfaces, the apparatus comprising:

a floor, a ceiling spaced from the floor a generally fixed distance approximately equal to said height of said articles, movable side walls capable of pressing against opposite ends of said row of articles, and a movable blocking gate projecting above the height of said floor, said gate being slidably disposed within a slot in said floor, and a motor for raising and lowering said gate relative to said floor.

Accordingly, it is an advantageous feature of the invention that a row of generally flat wrapped articles can be compressed for bagging, without causing the middle of the row to be forced out of line, and still be readily pushed into a bagger while in the compressed row form.

It is a related advantageous feature that such rows can be compressed without becoming jammed with non-aligned articles.

Other advantageous features will become apparent upon reference to the following Detailed Description, when read in light of the attached drawings.

DESCRIPTION OF THE PREFERRED EMBODIMENTS

The description hereinafter is in terms of the preferred embodiments, wherein a double row of wrapped, disposable pantiliner articles is lined up horizontally for compression, and compressed against a gate moved in a preferred manner to complete the compression, using compressor side walls activated by preferred drivers. In addition, the invention is useful whether there is one or more than one row, whether the disposable articles are pantiliners or some other feminine hygiene article, regardless how they are wrapped, and even if the one or more rows are only generally horizontal. It is further useful regardless of how the movable gate is moved into its blocking position, and how or by what means the compressor side walls are moved. As used herein, "generally horizontal" means, within 10 degrees of exactly horizontal, in any direction.

Figure 1:
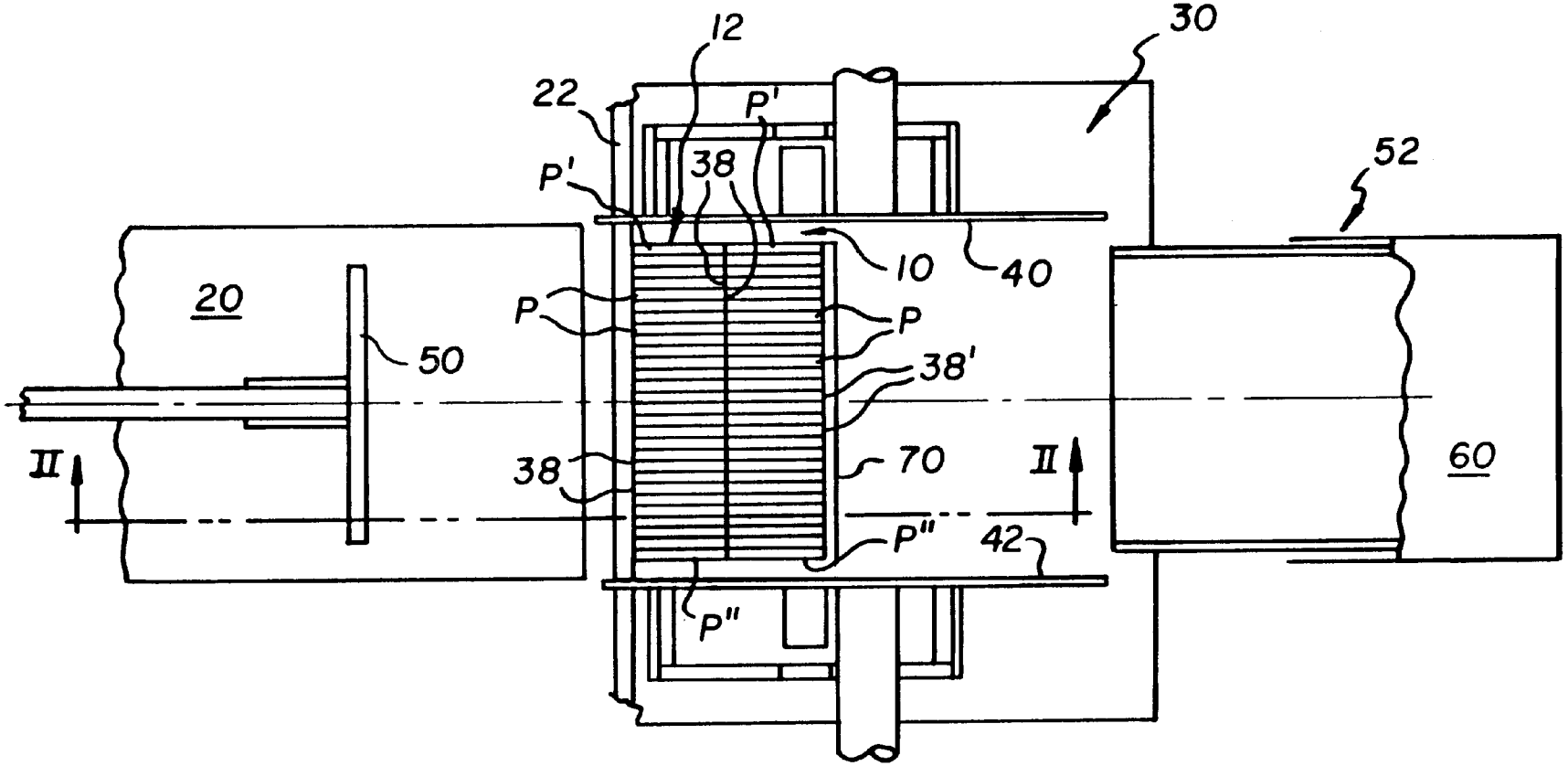
FIG. 1 is a fragmentary plan view, minus the ceiling, of a pre-bagging compression apparatus constructed in accordance with the invention, prior to compression, and of a downstream bagger.
Figure 2:
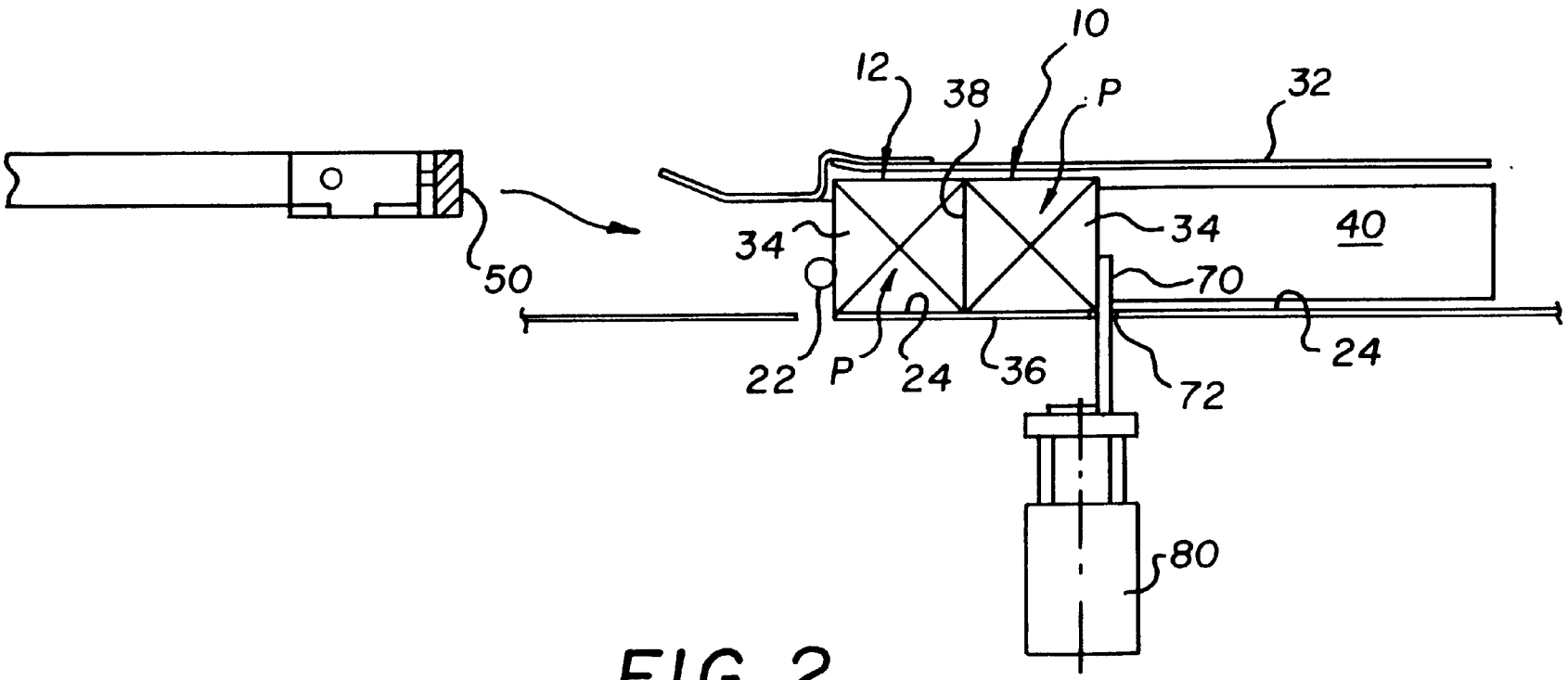
FIG. 2 is a fragmentary section view taken generally along the line II—II of FIG. 1.

Turning now to FIG. 1, it is conventional to move one or two rows 10, 12, of wrapped disposable feminine hygiene articles "P" across a conveyor 20 using, e.g., a flight bar 22, onto a floor 24 of a pre-bagging apparatus 30. Such apparatus 30 also conventionally features a ceiling 32 spaced a generally fixed height. That is, the distance is invariant during the process but not necessarily constant in the "x' direction, FIG. 2, from floor 24, so that the articles P are encouraged to remain upright during compression. That is, the fixed height is approximately equal to the height of an article P disposed with a major surface 34 thereof in approximate contact with a major surface 34 of an adjacent article P, and an end surface 36 resting on floor 24. One of opposed side surfaces 38 is in contact, in the case of a double row, with the side surface of the next adjacent row of articles P.

Pre-bagging apparatus 30 further conventionally includes two opposed, movable side walls 40, 42 mounted on plates 44 driven by pistons 46 and appropriate actuating means for linearly moving pistons 46, not shown, and a pusher plate 50. Highly preferred actuating means are cams and cam followers, but other means such as stepper motors and pneumatic cylinders can be used. Such actuating means are also useful in moving plate 50 towards and away from contact with row 12.

Heretofore, apparatus 30 operated by advancing pistons 46 about 2.54 cm each, until end articles P' and P" of each row were contacted. At the same time, pusher plate 50 was moved into uniform contact with side surfaces 38 of row 12, and plate 50 and side walls 40, 42 were pushed further to compact rows 10 and 12 into the close-packed configuration shown in FIG. 3. Such a row is then pushed by plate 50, arrow 51, into bagger 52 shown as two fixed sidewalls 54, 56, and a bag 60 at one end thereof, FIG. 3 especially. Further details of bagger 52 are not included, since the bagger is conventional. However, heretofore, there was no surface in contact with the exposed side surfaces 38' of row 10. As a result, articles P between P' and P" of row 10 occasionally "blew" out of alignment, spoiling the compressed row prior to bagging.

In accordance with the invention, apparatus 30 further includes a movable blocking gate 70 mounted to movably project above floor 24 with a height sufficient, in one position, to constitute a fixed surface against which side surfaces 38' of row 10 are pushed. As shown, FIGS. 1–4, this is accomplished by providing a slot 72 in floor 24, and mounting gate 70 vertically for sliding movement through slot 72 so as to either project above the floor, FIG. 1, or to be lowered to a position at or below the floor, FIG. 4. To raise and lower gate 70 in this arrangement, a motor 80 is provided, which is preferably a pneumatic cylinder. Alternatively, motor 80 can be a linear motor or a cam mechanism driven by a rotary cam and cam shaft (not shown). Guide walls, not shown, can be positioned to ensure gate 70 remains in alignment with slot 72. When compression is complete, FIG. 3, gate 70 is lowered by motor 80, arrow 81, FIG. 4, and whatever rows have been compressed (10, 12) are then pushed by plate 50, while still compressed between closed side walls 40, 42, over lowered gate 70 and into bagger 52, arrows 51.

Figure 3:
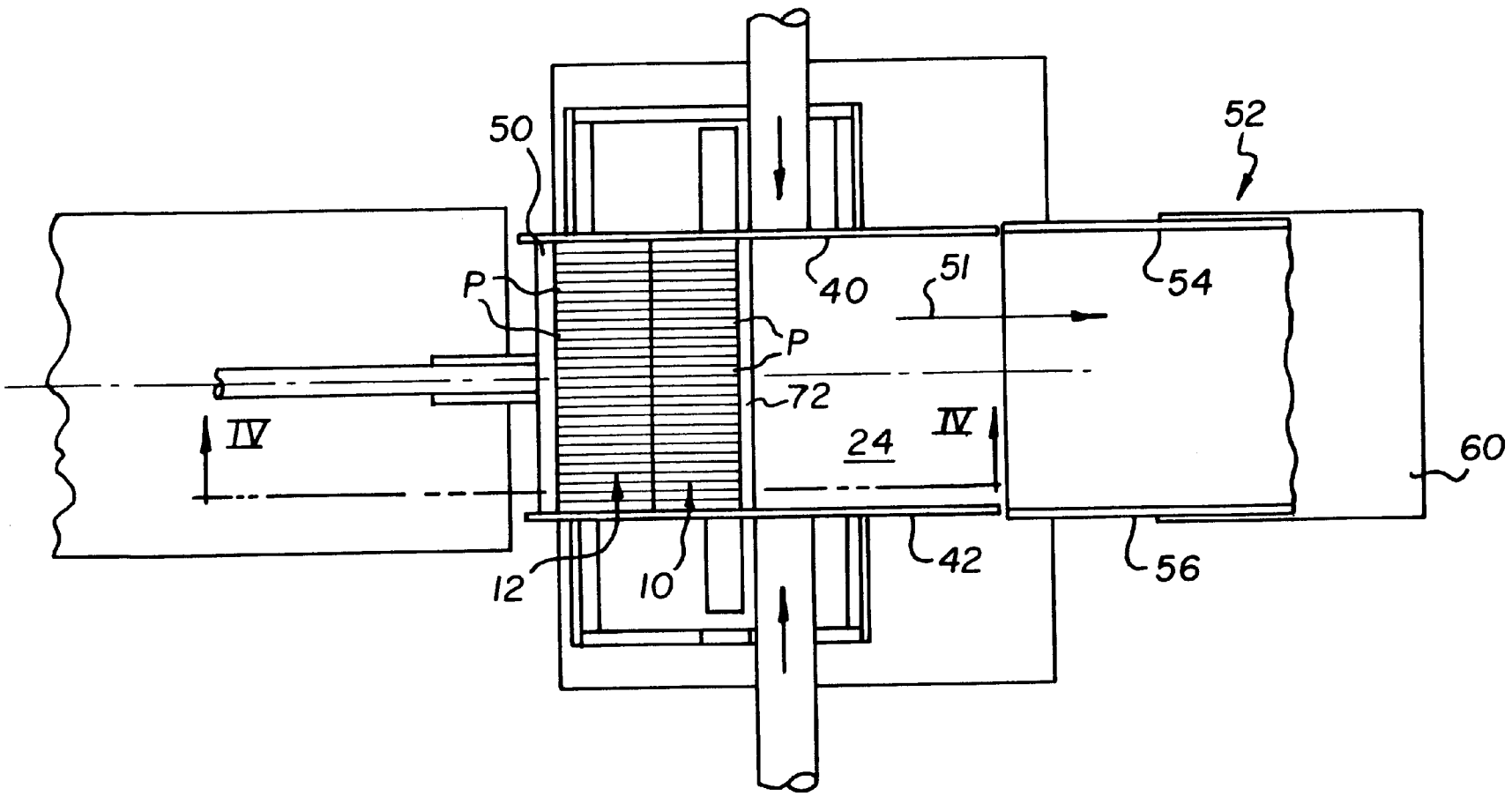
FIG. 3 is a plan view similar to that of FIG. 1, but showing the apparatus after compression and with the gate down.
Figure 4:
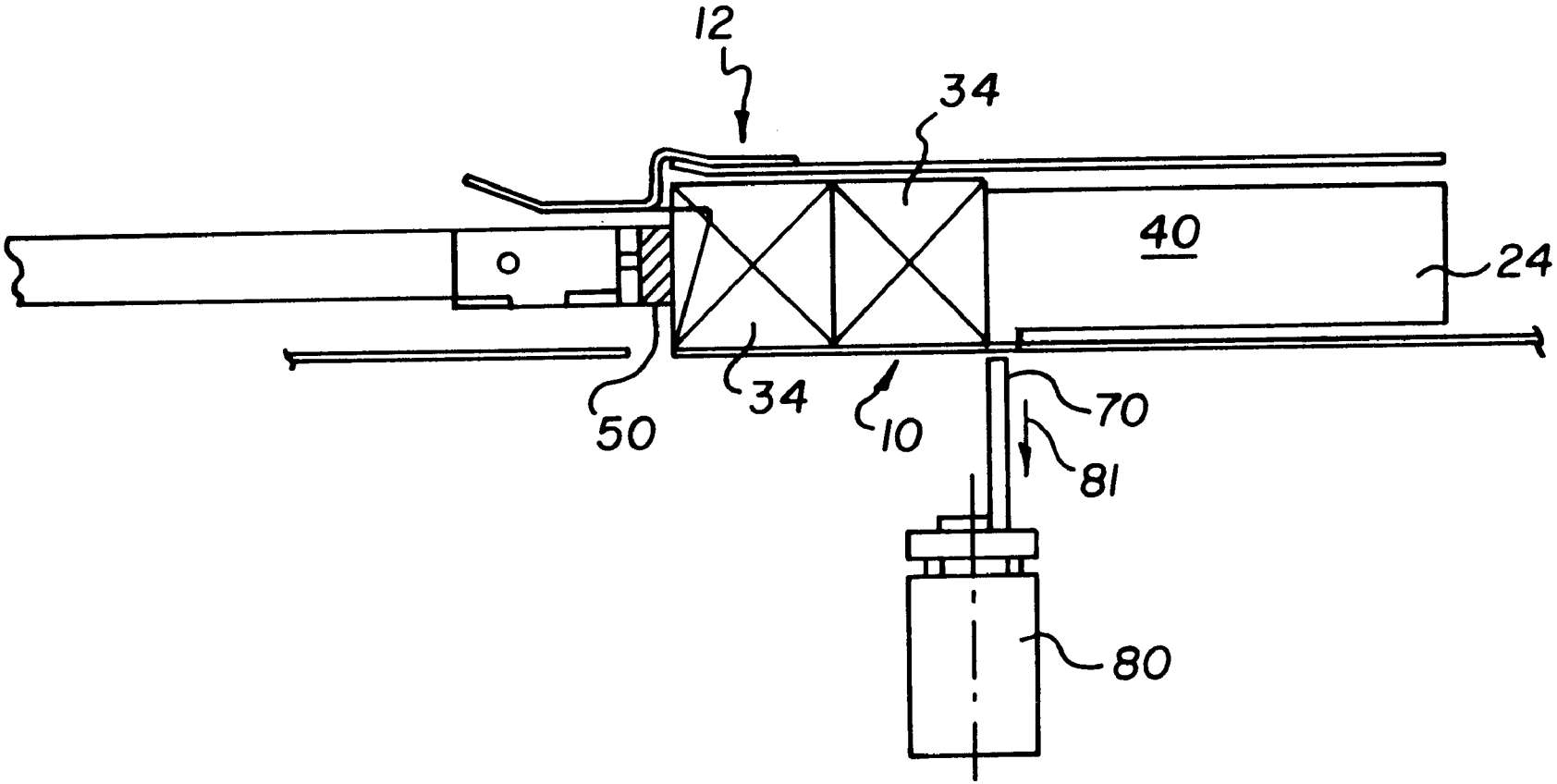
FIG. 4 is a fragmentary section view taken generally along the line IV—IV of FIG. 3.

Side walls 40 can be kept spaced apart as shown in FIG. 1 until rows 10 and 12 are exactly positioned as shown, or can be advanced slowly towards their position shown in FIG. 3 as rows 10 and 12 are being pushed in by bar 22.

In this manner, gate 70 prevents row 10 from "blowing out" in the middle portion, during compression, while still allowing transfer to bagger 52 after compression. Because of the use of gate 70, it has been found that rows 10 and 12 can be extended much further in length, for example to include as many as 28 articles in a row, compared to previous compression apparatus.

Figure 5:
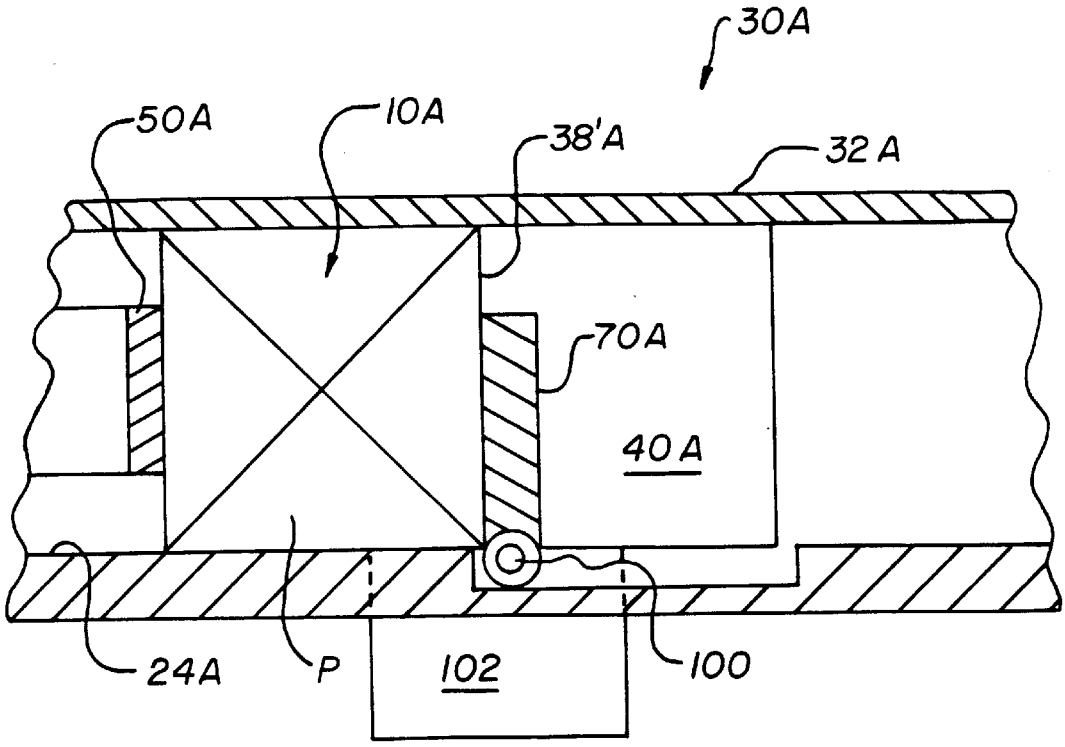
FIG. 5 is a section view similar to that of FIG. 4, except that it illustrates another embodiment during compression, with the gate still up.
Figure 6:
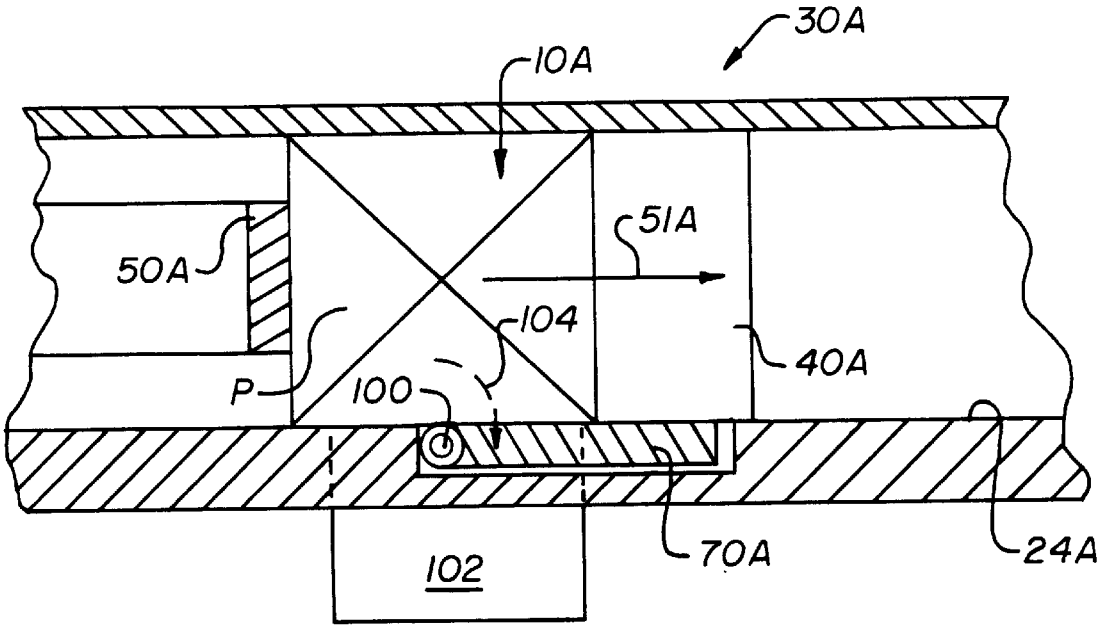
FIG. 6 is a view similar to that of FIG. 5, except that the gate is down to allow the row to be moved into the bagger.

A variety of mechanisms can be used to mount gate 70 for raising and lowering it relative to the floor. Thus, it need not be slid vertically through a slot, but it can alternatively be pivoted about a generally horizontal hinge, FIGS. 5 and 6. Parts similar to those previously described bear the same reference numeral, to which the distinguishing suffix "A" has been appended.

More specifically, compression apparatus 30A comprises a floor 24A, ceiling 32A, movable side walls (40A only being shown) and a pusher plate 50A to compress a row 10A of articles P, as described above. Movable gate 70A is also provided to contact side surfaces 38'A during compression, FIG. 5, also as in the previous embodiment. However, gate 70A is hingedly pivoted at generally horizontal hinge 100, and is rotated about hinge 100 by any suitable motor 102, so that gate 70A rotates, phantom arrow 104, to lower until it is level with floor 24A, out of the way of movement of row 10A, arrow 51A, FIG. 6, on to the bagger, not shown.

The invention has been described in detail with particular reference to preferred embodiments thereof, but it will be understood that variations and modifications can be effected within the spirit and scope of the invention. For example, although other features can be added besides those described, it is also useful free of any other features. That is, it can consist of only the enumerated parts.

What is claimed is:

1. A method of preventing blow-out of a row of generally flat wrapped disposable feminine hygiene articles, when compressing said row prior to bagging, said articles each comprising two major opposing surfaces, two opposing side surfaces, and two end surfaces; the method comprising the steps of:

a) placing a plurality of such articles on a platform in a generally horizontal row of a predetermined height so that each article is vertically disposed on said platform with at least one major surface in approximate contact with a major surface of an adjacent article and an end surface resting on said platform;

b) moving said row into a pre-bagging apparatus comprising a floor, a ceiling spaced from the floor a generally fixed distance approximately equal to said height, movable side walls capable of pressing against opposite ends of said row of articles, and a movable blocking gate projecting above the height of said floor, said moving step continuing until a first side edge of each article in said row is abutted against and in contact with said blocking gate; and c) while moving said movable side walls together to push against said opposite row ends, pushing uniformly against said row along another side edge of said articles opposite to said first side edge, thereby compressing said row into a minimized volume suitable for bagging, without blow-out of articles from said row.

2. A method as defined in claim 1, and further including the subsequent step of d) moving said movable gate away from said compressed row and out of contact with said first side edges, so that said compressed row can be moved out of said pre-bagging apparatus and into a bag.

3. A method as defined in claim 2, wherein said moving step d) comprises the step of vertically lowering said gate through said floor until it no longer projects above the height of said floor.

4. A method as defined in claim 2, wherein said movable gate is hingedly attached to said floor along a horizontal hinge positioned flush with said height of said floor, and wherein said step d) comprises the step of pivoting said gate about its hinge until it is flush with said floor and no longer projects above the height of said floor.

5. A method of bagging a row of generally flat wrapped disposable feminine hygiene articles, said articles each having two major opposing surfaces, two opposing side surfaces, and two end surfaces, the method comprising the steps of a) compressing said row by the method as defined in claim 2, and b) moving said compressed row into a bag.

6. A pre-bagging compression apparatus for compressing a row of flat wrapped articles each having a predetermined height and comprising two major opposing surfaces, two opposing side surfaces, and two end surfaces, the apparatus comprising:

a floor, a ceiling spaced from the floor a generally fixed distance approximately equal to said height of said articles, movable side walls capable of pressing against opposite ends of said row of articles, and a movable blocking gate projecting above the height of said floor, and means for raising and lowering said gate relative to said floor.

7. A pre-bagging compression apparatus for compressing a row of flat wrapped articles each having a predetermined height and comprising two major opposing surfaces, two opposing side surfaces, and two end surfaces, the apparatus comprising:

a floor, a ceiling spaced from the floor a generally fixed distance approximately equal to said height of said articles, movable side walls capable of pressing against opposite ends of said row of articles, and a movable blocking gate projecting above the height of said floor, said gate being slidably disposed within a slot in said floor, and a motor for raising and lowering said gate relative to said floor.

8. Apparatus as defined in claim 6 or 7, wherein said articles are disposable feminine hygiene articles.

9. Apparatus as defined in claim 6 or 7, wherein said floor includes a slot and said gate is raised and lowered through said slot.

* * * * *